US006840654B2

(12) United States Patent
Guerrieri et al.

(10) Patent No.: US 6,840,654 B2
(45) Date of Patent: Jan. 11, 2005

(54) LED LIGHT AND REFLECTOR

(75) Inventors: Salvitore Guerrieri, Garfield, NJ (US); Lawrence David Adelman, New York, NY (US)

(73) Assignee: Acolyte Technologies Corp., New York, NY (US)

( * ) Notice: Subject to any disclaimer, the term of this patent is extended or adjusted under 35 U.S.C. 154(b) by 0 days.

(21) Appl. No.: 10/300,245

(22) Filed: Nov. 20, 2002

(65) Prior Publication Data

US 2004/0095763 A1 May 20, 2004

(51) Int. Cl.[7] ..... F21V 29/00

(52) U.S. Cl. ..... 362/241; 362/247; 362/294; 362/373; 362/249

(58) Field of Search ..... 362/249, 252, 362/241, 247, 800, 545, 373, 547, 294

(56) References Cited

U.S. PATENT DOCUMENTS

,080,622 A 6/1868 Pashley
3,923,394 A * 12/1975 Frankiewicz ..... 355/37
4,985,814 A * 1/1991 Lyons ..... 362/240
5,486,983 A * 1/1996 Cordier et al. ..... 362/29
5,490,049 A * 2/1996 Montalan et al. ..... 362/240
5,594,433 A 1/1997 Terlep
6,122,440 A * 9/2000 Campbell ..... 392/420
6,250,774 B1 * 6/2001 Begemann et al. ..... 362/231
6,361,190 B1 3/2002 McDermott
6,364,507 B1 4/2002 Yang
6,367,949 B1 * 4/2002 Pederson ..... 362/240
6,367,950 B1 * 4/2002 Yamada et al. ..... 362/245
6,499,870 B1 * 12/2002 Zwick et al. ..... 362/505

FOREIGN PATENT DOCUMENTS

WO WO 97/26483 7/1997
WO WO 02/14738 A1 2/2002

* cited by examiner

*Primary Examiner*—Thomas M. Sember
(74) *Attorney, Agent, or Firm*—Jonathan B. Schafrann

(57) ABSTRACT

An LED light is set out where there is a conical reflecting chamber and a rear housing to accommodate a series of light emitting diodes, each diode residing in a chamber adapted therefore, said chambers being both wide and narrow, and a circuit board contacts and pins for providing power thereto.

7 Claims, 5 Drawing Sheets

LED LIGHT AND REFLECTOR

FIELD OF THE INVENTION

The instant invention generally pertains to a reflector for an LED light and more specifically to an LED light and reflector, to intensify and modify the light from one or more light emitting diodes of an LED light bulb.

BACKGROUND AND SUMMARY OF THE INVENTION

With the advent of newer lighting systems a variety of problems and challenges arise. For example, with halogen lights, problems attendant to high temperatures and its hazards are well known. A light emitting diode transmits light in a specific angle, and to that end the light while bright and natural is difficult to focus and intensify for normal use. With light emitting diodes, the problem has been to gather and focus enough light to make the assemblage practicable. While a light emitting diode (hereinafter LED), requires minute amounts of electricity, generates little heat, and transmits a focused beam of light, there is a recognized problem of gathering enough light so that the LED light can compete with an incandescent, halogen or even a florescent light.

Given the advantages of LED light bulbs, there have been many attempts to utilize the benefits of such bulbs while minimizing the problems. Therefore, some users have constructed a lighting assemblage incorporating a series of LEDS, either as a strip of lights or as a geometrically set out area or lights.

To that end, the prior art discloses a series of reflectors that utilize the following physical parameters: (1) a cup shaped mirrored surface (2) one or more light emitting diodes and either a single cavity or a series of honey-combed cavities adapted to accept each LED.

Often times the light includes a series of LED's with a single reflective chamber wall. It as an alternate embodiment in the prior art that a honeycomb type reflector and light is most desirable. It should be noted that the honeycomb assemblage is constructed as a single light housed in a single reflector.

Prior Art

U.S. Pat. No. 6,361,190 B1 issued to McDermott sets out a large surface LED lighting device using a single reflecting means to increase the divergence of light.

An internationally published reference WO 02/14738A1 by Ming, discloses a combination of a reflector and magnifying lens to increase the brightness and utility of an LED light.

U.S. patent application US2002/0080622, to Pashley et al discloses a multifaceted cup assembly to increase the divergence and intensity of an LED light. While in U.S. Pat. No. 5,594,433 issued to Terlep, an omni-directional light utilizing an LED arises with the use of multiple facets. Moreover, there are flashlights using multiple LED lights and many other lighting devices.

OBJECTS OF THE INVENTION

An object of the instant invention is to provide an LED light, which uses a unique reflector system to provide a better quality light.

Another object of the instant invention is to provide an LED light, which uses a unique reflector system to provide a stronger and more easily focused light source.

Yet another object of the instant invention is to provide an LED light source, which may be varied as to the type of light, said light being uniform over the area of lighting.

SUMMARY OF THE INVENTION

Therefore, the instant invention provides an LED light bulb, which utilizes a unique reflector. The reflector which retains a plurality of LEDS is constructed to utilize a housing which is cone shaped on one end, while the other is adapted to retain at least a plug. Within the housing, resides a circuit board, which is in communication with the contacts from the plugs. The circuit board is in communication with the LEDS and controls said LEDS by supplying power thereto. A reflecting surface is retained by the cone shaped portion, and the reflecting surface is adapted to receive each LED, within a chamber constructed therefore. The chambers are curved and may be parabolic, hyperbolic or some combination thereof. Moreover, the chambers may be of either the same dimensions, or more narrow in the center and widening out in the periphery. Conversely, the chambers may be wider towards the center and narrow on the peripheral edge. Electronically, the bulb in accordance herewith may retrofit existing halogen fixtures.

BRIEF DESCRIPTION OF THE DRAWINGS

It should be understood, by one skilled in the art, that the drawings depict certain embodiments of the invention and therefore are not to be considered a limitation in the scope of the instant invention, but that these and other advantages of the present invention will be more fully understood by reference to the following detailed description when read in conjunction with the attached drawings in which.

DETAILED DESCRIPTION

Figure 1:
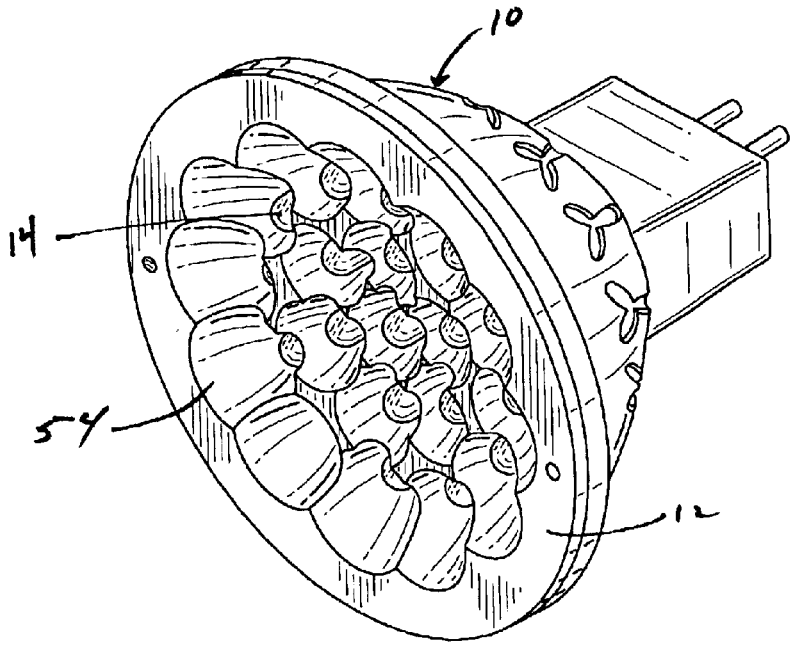
FIG. 1 is a front elevated view in perspective depicting the LED light and reflector.
Figure 5:
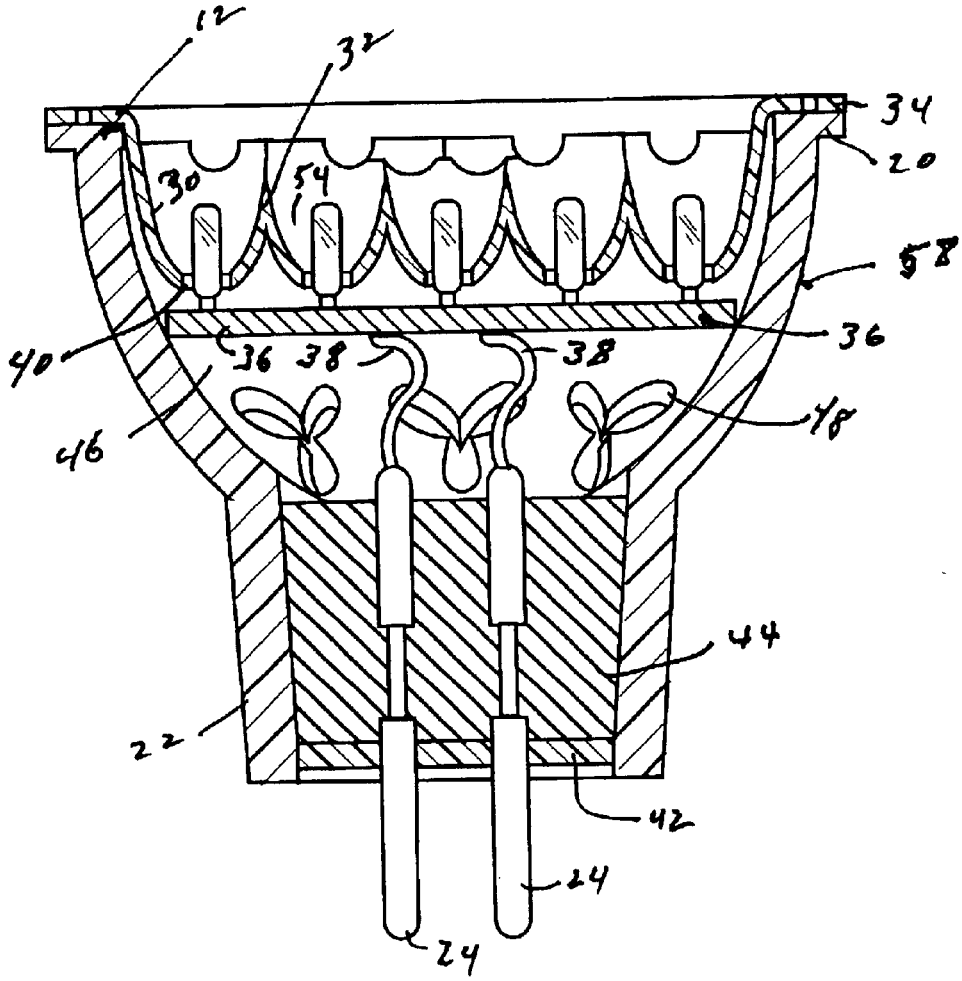
FIG. 5 is sectional view showing the chambers of one size thereof.

To wit, turning now with more specificity to the drawings, wherein like numerals refer to like parts throughout, the numeral 10 appertains generally to an LED light and reflector. For purposes of this disclosure light emitting diode will be termed LED for simplicity. FIG. 1 shows a general view of LED light and reflector 10 and in combination with FIG. 2 one can clearly see that said LED light and reflector 10 generally has a reflector 12, which accommodates a plurality of light emitting diodes 14. While a housing 58 may be almost any shape or configuration, it will be understood for example only, the shape will be described as a bulb shape as that is known in the industry so that LED light and reflector 10 occupies similar space to the incandescent or halogen bulb that it is designed to substitute. Therefore, a housing 58 as seen in FIG. 5, is fashioned to include a conical member 16 on one end, which integrally flows into a housing 22 for pins 24.

Figure 2:
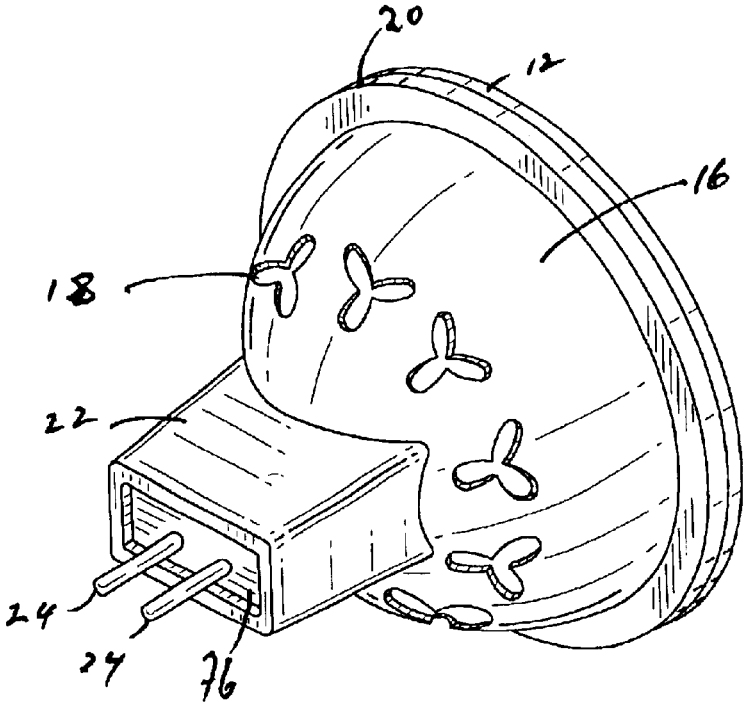
FIG. 2 is a rear elevated view in perspective thereof.

As illustrated by FIG. 2 and set out circumferentially around conical member 16 is a plurality of annular vents 18.

Although the general shape of LED light and reflector 10 can be of almost any configuration, it is generally preferred that the curved and rounded shape is used to "retro-fit" existing light sockets. More particularly, as set out is a configuration that is designed to generally retrofit existing halogen-type and other bulb sockets. Moreover, LED light and reflector 10 can be fashioned from any heat resistant, rigid thermoplastic polymer derived from acrylics, carbonates, vinyl-derivatives and mixtures thereof. Obviously, price, rigidity, durability, and heat resistance militate to the choice of the specific polymer. Advantageously, LEDS do not generate much heat and therefore, may be used in operative conjunction with almost any rigid polymer. Moreover, FIG. 2 further illustrates the conformation of pins 24, and an indented area 76 for reversibly attaching LED light and reflector 10 to a power source or bulb holder.

Figure 4:
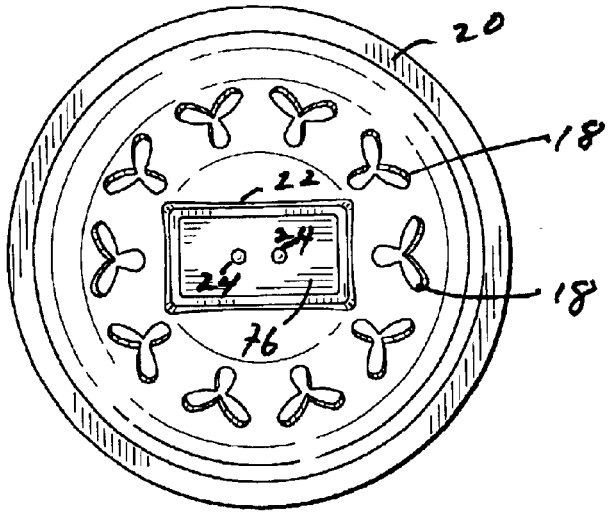
FIG. 4 is a rear plan view thereof.

FIG. 4 best shows as a compliment to FIG. 2 pins 24 and the circumferential disposition of annular vents 18. Indented area 76 and pins 24 as stated hereinabove fit into a holder adapted therefore to receive power. As an illustrative embodiment, FIG. 5 sets out retention area 44 which supports and holds pins 24.

Figure 3:
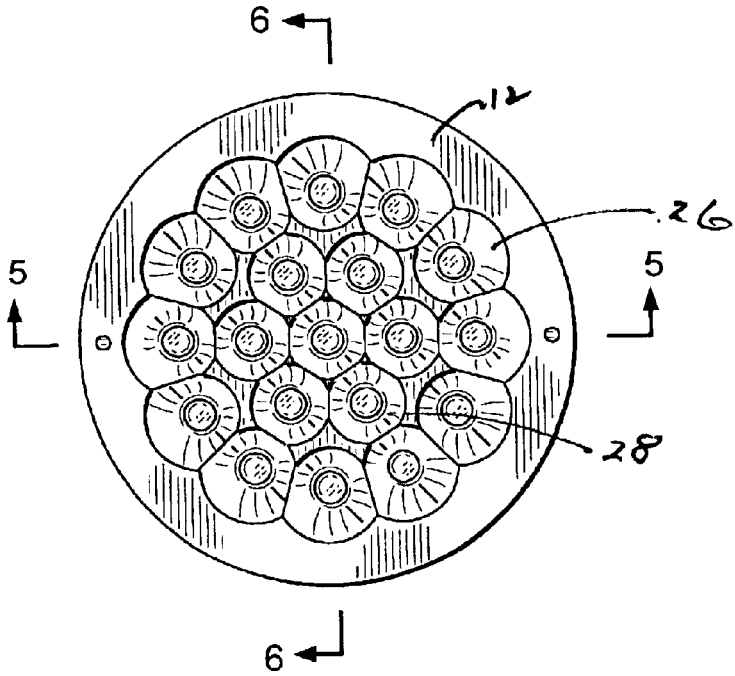
FIG. 3 is a front plan view thereof taken along lines 5—5 of FIG. 5 and 6—6 of FIG. 6.
Figure 6:
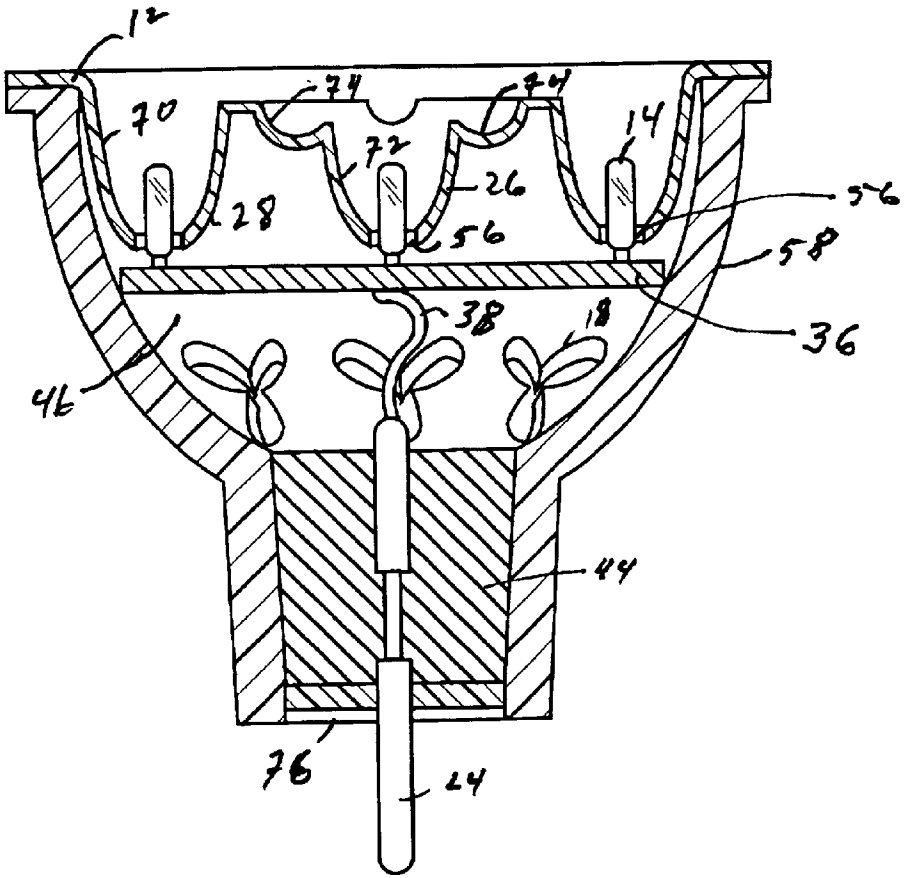
FIG. 6 is a sectional view showing chambers of different sizes thereof.

Reflector 12 as illustrated by FIGS. 1, 3, 5 and 6 is of a unique configuration, and is constructed to include a plurality of chambers 54 said chambers forming a honeycomb shaped arrangement of LEDS. The surface of reflector 12 may be of a metallic nature so that the resulting reflector may be mirrored silvered as by depositing metallic particles or by the use of a mylar film. Said chambers 54 may be either of the same dimensions as shown in FIG. 5 or may be of varied dimension, or combinations thereof. FIGS. 1 and 3 show an embodiment where chambers 54 are of varied dimension. FIG. 3 clearly depicts an embodiment where the outer chambers 26 are larger and wider than smaller and narrower inner chambers 28. As a result the light generated by the use of larger and wider outer chambers 26 and smaller and narrower inner chambers 28 is better focused and dispersed thereby and therefore can approximate a halogen-type bulb. As a general rule, outer chamber 26 and inner chamber 28 may be individually parabolic, hyperbolic or generally elliptical in overall geometry. Upstanding wall of outer chamber 26 and inner chamber 28 may be gently curving or essentially straight as best seen in FIGS. 5 and 6. In accordance with said FIGS. 5 and 6, upstanding chamber wall 52 of reflector plate 34 may be of a single height as in FIG. 5 or in a more preferred embodiment in FIG. 6 may be of different heights a shorter chamber wall 74 in the center and relatively close thereto and a taller chamber wall 70 corresponding to one or more rows of peripheral chambers. Hence in accordance with FIG. 6 so that narrow chamber walls 28 are taller than wider chamber walls 26. As another embodiment, chamber 54 may be of the same dimension.

Again, in accordance with FIG. 6, given chambers 26 and 28 being wider and narrower, one can utilize a conformation where the chambers are symmetrically set out as well as being set out in random conformation. It should be noted that the wider chamber 26 is further constructed of a wall configuration of upstanding wall 72 and area 74. Hence, wider chamber 26 is further constructed of a combination of an inner wall 72 and a wider outer wall 74 integral thereto. In accordance with FIG. 1, it is preferred that there are wider and narrower chambers to more evenly distribute the light so that there is no area that is devoid of light. The resulting chamber may be elliptical, parabolic, hyperbolic or any combination thereof. The resulting chamber is as well, reflective containing a mirrored reflective surface 50 of FIG. 3.

Reflector 12 as exemplified by FIGS. 1, 3, 5 and 6 show reflector plate 34, which is communication with retention lip 20 and held immovably thereon as by sonic welding, adhesives, snap-on mated surfaces or any means for fastening lip 20 and conical housing 16 to reflector 12. Reflector plate 34 has a reflector-type finish and provides an aperture 56 of sufficient dimension to accommodate LED 14 therethrough located at the bottom of chambers 26 and 28. It should be noted that any metallic or non-metallic reflective coating may be operatively substituted.

As best seen in FIGS. 5 and 6 is chamber 46, which arises as a result of circuit board 36 fitted within conical shaped member 16 and is designed to concentrate whatever heat evolves from contacts 38 and circuit board 36. Within the wall of conical shaped member 16 are annular vents 18, said vents 18 forming a ventilation system 48 to dissipate heat from chamber 46 by said plurality of annular heat dissipation vents 18. It is an inherent characteristic of LEDS that the cooler the temperature the more efficiently they function. Therefore, the heat retention and dissipation qualities of chamber 46 and the heat dissipation through ventilation system 48 of FIG. 5, and creates an environment for the most efficient functioning of LEDS 14. It should be noted that aperture 40 of FIG. 5 allows for some heat dissipation forward and around LED. The combination of aperture 40 heat dissipation chamber 46, annular vents 18 coalesce to form ventilation system 48. FIG. 5 also illustrates an embodiment wherein the upstanding chamber walls 30 and 32 are of the same height.

Figure 7:
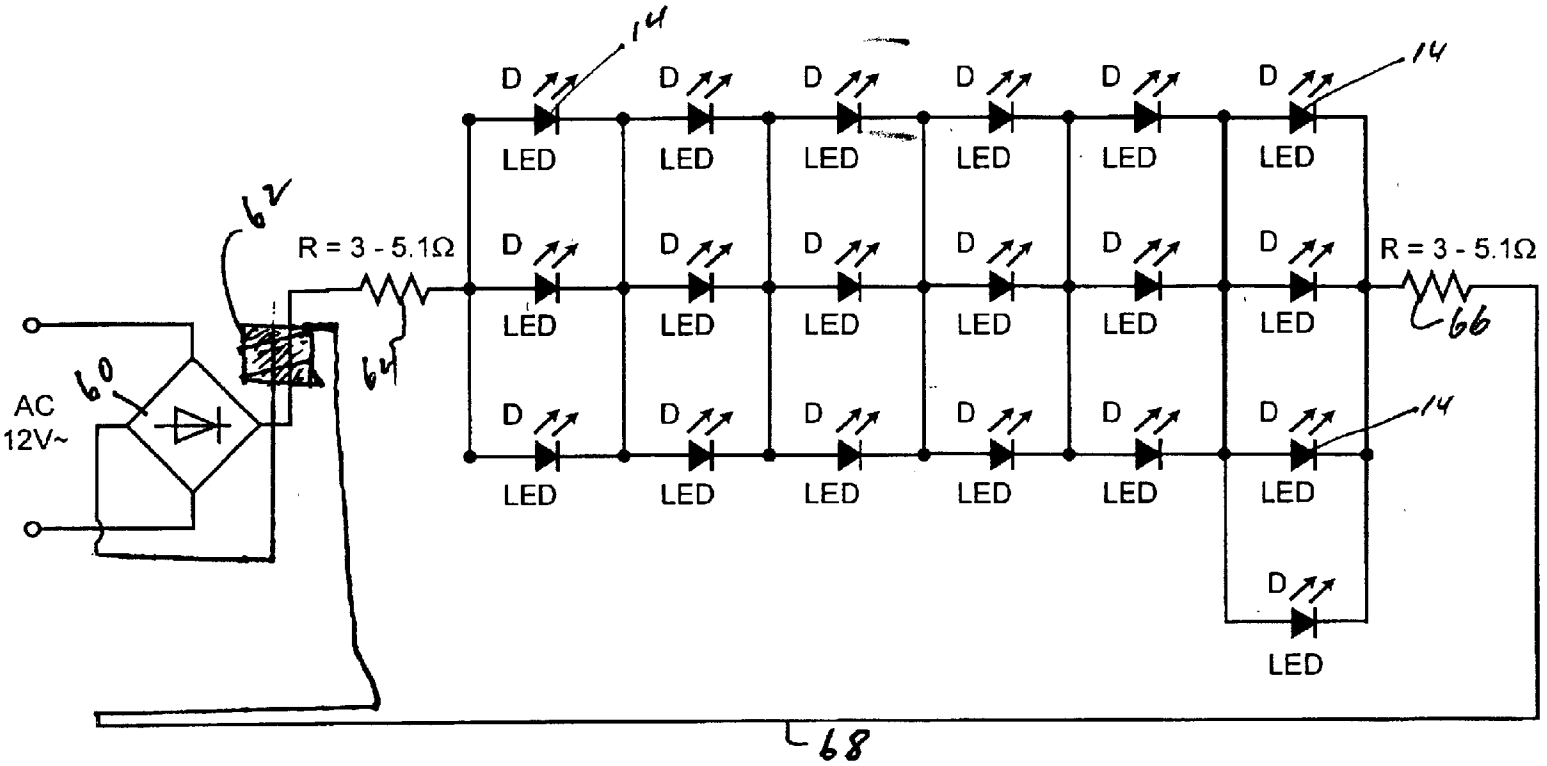
FIG. 7 is a diagrammatic view of the circuit board and circuitry for an LED light and reflector.

Circuit board 36 of FIGS. 5 and 6 is set out with more specificity in the diagram of FIG. 7. FIG. 7 shows the function and structure of circuit board 36. As a preferred embodiment, circuit board 36 may be a printed circuit board of ordinary manufacture. To wit circuit board 36 is fashioned as follows and utilizes the methodology as outlined hereinbelow. A power source 60 supplies power to a bridge rectifier 62, which in turn has the ability to convert alternating current to direct current and vice versa. From bridge rectifier 62 the current passes through a resister 64 and activates LEDS 14. From LEDS 14 the current passes to another resistor 66 and back to the power source via bridge rectifier 64 or diode configuration having either capacitors and/or resistors as mentioned herein. The circuit transmits power via a printed circuit 68 or a like modality. The advantage of such an embodiment turns on the ability to light each LED with approximately the same intensity and if one happens to fail the others will still light. Each LED 14 is held in communication with said circuit board 36 by an affixing technique like soldering although the exact affixing technique is of little moment. It is preferred in an embodiment that LEDS 14 are wired in series.

FIGS. 5 and 6 show pins 24 which are held in place by communication within housing 22. While housing 22 may be solid as in FIG. 5, retention area 44 or hollow it may also be of other constructions, sufficient to support pins 24, said retention area 44 bounded by retention plate 42. Pins 24 may be round, flat or of any shape adapted to be accepted within a bulb holder, said bulb holder is neither illustrated nor claimed and are adapted to transmit power therethrough.

Pins 24 transmit power to contacts 38, thereby providing power to the LEDS by contacting circuit board 36 with a power source 60, while power source 60 may be remote from the LED light and reflector 10. Contacts 38 transmit the regulated power to LEDS 14.

While the foregoing embodiments of the invention have been set forth in considerable detail for the purposes of making a complete disclosure of the invention, it will be apparent to those of skill in the art that numerous changes may be made in such details without departing from the spirit and the principles of the invention.

We claim:

1. An LED light and reflector comprising:

a housing that is conically shaped and open on one end and shaped to be adapted to retain a power transferring means on the other;

a reflector adapted to be in communication with said conically shaped open end, said reflector possessing a plurality of individual chambers;

a plurality of light emitting diodes corresponding to said plurality of individual chambers such that said chambers form a honeycomb arrangement of a plurality of outer and inner chambers wherein said outer and inner chambers upstanding chamber walls, so that said outer chamber walls are taller than said inner chamber walls and said outer chambers are wider than said inner chambers which are narrower than said outer chambers and the area in between is reflective, and a circuit board in communication with said plurality of light emitting diodes on one side and at least two contacts on the other side to provide a regulated current to said plurality of light emitting diodes wherein said circuit board communicates with said conical member to form a heat retention chamber, and a plurality of annular heat dissipation vents.

2. The plurality of outer and inner chambers as in claim 1 forming outer chambers and inner chambers of different widths.

3. The plurality of outer and inner chambers of different widths as in claim 1 wherein said chambers of different widths are set out as a random assortment and conformation.

4. The plurality of chambers as in claim 1 wherein said chambers are parabolic, elliptical and combinations thereof.

5. The plurality of chambers as in claim 1 wherein said chambers are reflective.

6. The circuit board as described in claim 1 further comprising: a printed circuit board adapted to receive power from a power source, said power source being remote from said LED light and reflector;

a bridge rectifier adapted to convert alternating current to direct current, a resistor sufficient to regulate said direct current and providing power to a plurality of LEDS, said plurality of light emitting diodes being disposed in series;

a resistor to regulate power exiting from said plurality of light emitting diodes, and means for transmitting the power back to said bridge rectifier and to said power source.

7. The means for transmitting power as described in claim 1 wherein said means is a printed circuit.

* * * * *